US006211137B1

(12) United States Patent
Beimesch et al.

(10) Patent No.: US 6,211,137 B1
(45) **Date of Patent: *Apr. 3, 2001**

(54) PROCESS FOR MAKING A DETERGENT COMPOSITION BY NON-TOWER PROCESS

(75) Inventors: Wayne Edward Beimesch, Covington, KY (US); Jose Francisco Correa Romo, Edo. de Mexico (MX); Steven Barrett Rogers, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/269,850

(22) PCT Filed: Jun. 5, 1997

(86) PCT No.: PCT/US97/09794

§ 371 Date: Apr. 1, 1999

§ 102(e) Date: Apr. 1, 1999

(87) PCT Pub. No.: WO98/14556

PCT Pub. Date: Apr. 9, 1998

(30) Foreign Application Priority Data

Oct. 4, 1996 (WO) ..... PCT/US96/15881

(51) Int. Cl.[7] ..... C11D 11/00

(52) U.S. Cl. ..... 510/444; 510/351; 510/361; 510/495; 510/498; 510/509; 510/510; 510/512; 264/117; 264/140

(58) Field of Search ..... 510/444, 351, 510/361, 495, 498, 509, 510, 512; 264/117, 140

(56) References Cited

U.S. PATENT DOCUMENTS

| | | | | |
|---|---|---|---|---|
| 4,846,409 | | 7/1989 | Kaspar et al. | 241/21 |
| 5,164,108 | * | 11/1992 | Appel et al. | 510/444 |
| 5,489,392 | * | 2/1996 | Capeci et al. | 510/444 |
| 5,496,486 | * | 3/1996 | Staley | 510/444 |
| 5,496,487 | * | 3/1996 | Capeci et al. | 510/444 |
| 5,516,448 | * | 5/1996 | Capeci et al. | 510/444 |
| 5,554,587 | | 9/1996 | Capeci | 510/444 |
| 5,691,297 | * | 11/1997 | Nassano et al. | 510/444 |

FOREIGN PATENT DOCUMENTS

| | | | |
|---|---|---|---|
| 44 35 743 A1 | 8/1995 | (DE) | C11D/3/08 |
| WO 93/25378 | 12/1993 | (WO) | B29C/67/02 |
| 9405761 * | 3/1994 | (WO) . | |
| WO 95/12659 | 5/1995 | (WO) | C11D/11/00 |
| WO 96/04359 A1 | 2/1996 | (WO) | C11D/11/04 |
| WO 97/22685 | 6/1997 | (WO) | C11D/17/06 |
| WO 97/28246 | 8/1997 | (WO) | C11D/17/06 |

* cited by examiner

*Primary Examiner*—Lorna M. Douyon
(74) *Attorney, Agent, or Firm*—Brian M. Bolam; Kim William Zerby; Steven W. Miller

(57) ABSTRACT

A non-tower process for continuously preparing granular detergent compositions having a density of at least of about 600 g/l comprises the steps of (a) dispersing a surfactant, and coating the surfactant with fine powder having a diameter from 0.1 to 500 microns, in a mixer, wherein first agglomerates are formed and (b) granulating the first agglomerates in one or more fluidizing apparatus.

10 Claims, No Drawings

PROCESS FOR MAKING A DETERGENT COMPOSITION BY NON-TOWER PROCESS

FIELD OF THE INVENTION

The present invention generally relates to a non-tower process for producing a particulate detergent composition. More particularly, the invention is directed to a continuous process during which detergent agglomerates are produced by feeding a surfactant and coating materials into a series of mixers. The process produces a free flowing, detergent composition whose density can be adjusted for wide range of consumer needs, and which can be commercially sold.

BACKGROUND OF THE INVENTION

Recently, there has been considerable interest within the detergent industry for laundry detergents which are "compact" and therefore, have low dosage volumes. To facilitate production of these so-called low dosage detergents, many attempts have been made to produce high bulk density detergents, for example with a density of 600 g/l or higher. The low dosage detergents are currently in high demand as they conserve resources and can be sold in small packages which are more convenient for consumers. However, the extent to which modern detergent products need to be "compact" in nature remains unsettled. In fact, many consumers, especially in developing countries, continue to prefer a higher dosage levels in their respective laundering operations.

Generally, there are two primary types of processes by which detergent granules or powders can be prepared. The first type of process involves spray-drying an aqueous detergent slurry in a spray-drying tower to produce highly porous detergent granules (e.g., tower process for low density detergent compositions). In the second type of process, the various detergent components are dry mixed after which they are agglomerated with a binder such as a nonionic or anionic surfactant, to produce high density detergent compositions (e.g., agglomeration process for high density detergent compositions). In the above two processes, the important factors which govern the density of the resulting detergent granules are the shape, porosity and particle size distribution of said granules, the density of the various starting materials, the shape of the various starting materials, and their respective chemical composition.

There have been many attempts in the art for providing processes which increase the density of detergent granules or powders. Particular attention has been given to densification of spray-dried granules by post tower treatment. For example, one attempt involves a batch process in which spray-dried or granulated detergent powders containing sodium tripolyphosphate and sodium sulfate are densified and spheronized in a Marumerizer®. This apparatus comprises a substantially horizontal, roughened, rotatable table positioned within and at the base of a substantially vertical, smooth walled cylinder. This process, however, is essentially a batch process and is therefore less suitable for the large scale production of detergent powders. More recently, other attempts have been made to provide continuous processes for increasing the density of "post-tower" or spray dried detergent granules. Typically, such processes require a first apparatus which pulverizes or grinds the granules and a second apparatus which increases the density of the pulverized granules by agglomeration. While these processes achieve the desired increase in density by treating or densifying "post tower" or spray dried granules, they are limited in their ability to go higher in surfactant active level without subsequent coating step. In addition, treating or densifying by "post tower" is not favourable in terms of economics (high capital cost) and complexity of operation. Moreover, all of the aforementioned processes are directed primarily for densifying or otherwise processing spray dried granules. Currently, the relative amounts and types of materials subjected to spray drying processes in the production of detergent granules has been limited. For example, it has been difficult to attain high levels of surfactant in the resulting detergent composition, a feature which facilitates production of detergents in a more efficient manner. Thus, it would be desirable to have a process by which detergent compositions can be produced without having the limitations imposed by conventional spray drying techniques.

To that end, the art is also replete with disclosures of processes which entail agglomerating detergent compositions. For example, attempts have been made to agglomerate detergent builders by mixing zeolite and/or layered silicates in a mixer to form free flowing agglomerates. While such attempts suggest that their process can be used to produce detergent agglomerates, they do not provide a mechanism by which starting detergent materials in the form of pastes, liquids and dry materials can be effectively agglomerated into crisp, free flowing detergent agglomerates.

Accordingly, there remains a need in the art to have an agglomeration (non-tower) process for continuously producing a detergent composition having high density delivered directly from starting detergent ingredients, and preferably the density can be achieved by adjusting the process condition. Also, there remains a need for such a process which is more efficient, flexible and economical to facilitate large-scale production of detergents (1) for flexibility in the ultimate density of the final composition, and (2) for flexibility in terms of incorporating several different kinds of detergent ingredients (especially liquid ingredients) into the process.

The following references are directed to densifying spray-dried granules: Appel et al, U.S. Pat. No. 5,133,924 (Lever); Bortolotti et al, U.S. Pat. No. 5,160,657 (Lever); Johnson et al, British patent No. 1,517,713 (Unilever); and Curtis, European Patent Application 451,894.

The following references are directed to producing detergents by agglomeration: Beujean et al, Laid-open No.WO93/23,523 (Henkel), Lutz et al, U.S. Pat. No. 4,992,079 (FMC Corporation); Porasik et al, U.S. Pat. No. 4,427,417 (Korex); Beerse et al, U.S. Pat. No. 5,108,646 (Procter & Gamble); Capeci et al, U.S. Pat. No. 5,366,652 (Procter & Gamble); Hollingsworth et al, European Patent Application 351,937 (Unilever); Swatling et al, U.S. Pat. No. 5,205,958; Dhalewadikar et al, Laid Open No.WO96/04359 (Unilever).

For example, the Laid-open No.WO93123,523 (Henkel) describes the process comprising pre-agglomeration by a low speed mixer and further agglomeration step by high speed mixer for obtaining high density detergent composition with less than 25 wt % of the granules having a diameter over 2 mm. The U.S. Pat. No. 4,427,417 (Korex) describes continuous process for agglomeration which reduces caking and oversized agglomerates.

None of the existing art provides all of the advantages and benefits of the present invention.

SUMMARY OF THE INVENTION

The present invention meets the aforementioned needs in the art by providing a process which produces a high density granular detergent composition. The present invention also meets the aforementioned needs in the art by providing a process which produces a granular detergent composition for flexibility in the ultimate density of the final composition from agglomeration (e.g., non-tower) process. The process does not use the conventional spray drying towers currently which is limited in producing high surfactant loading compositions. In addition, the process of the present invention is more efficient, economical and flexible with regard to the variety of detergent compositions which can be produced in the process. Moreover, the process is more amenable to environmental concerns in that it does not use spray drying towers which typically emit particulates and volatile organic compounds into the atmosphere.

As used herein, the term "agglomerates" refers to particles formed by agglomerating raw materials with binder such as surfactants and or inorganic solutions/organic solvents and polymer solutions. As used herein, the term "granulating" refers to fluidizing agglomerates thoroughly for producing free flowing, round shape granulated-agglomerates. As used herein, the term "mean residence time" refers to following definition:

mean residence time (hr)=mass (kg)/flow throughput (kg/hr)

All percentages used herein are expressed as "percent-by-weight" unless indicated otherwise. All ratios are weight ratios unless indicated otherwise. As used herein, "comprising" means that other steps and other ingredients which do not affect the result can be added. This term encompasses the terms "consisting of" and "consisting essentially of".

In accordance with one aspect of the invention, a process for preparing a granular detergent composition having a density at least about 600 g/l is provided. The process comprises the steps of;

(a) dispersing a surfactant, and coating the surfactant with fine powder having a diameter from 0.1 to 500 microns, in a mixer wherein conditions of the mixer include (i) from about 2 to about 50 seconds of mean residence time, (ii) from about 4 to about 25 m/s of tip speed, and (iii) from about 0.15 to about 7 kj/kg of energy condition, wherein agglomerates are formed; and (b) granulating the agglomerates in one or more fluidizing apparatus wherein conditions of each of the fluidizing apparatus include (i) from about 1 to about 10 minutes of mean residence time, (ii) from about 100 to about 300 mm of depth of unfluidized bed, (iii) not more than about 50 micron of droplet spray size, (iv) from about 175 to about 250 mm of spray height, (v) from about 0.2 to about 1.4 m/s of fluidizing velocity and (vi) from about 12 to about 100° C. of bed temperature.

Also provided are the granular detergent compositions having a high density of at least about 600 g/l, produced by any one of the process embodiments described herein.

Accordingly, it is an object of the invention to provide a process for continuously producing a detergent composition which has flexibility with respect to density of the final products by controlling energy input, residence time condition, and tip speed condition in the mixers. It is also an object of the invention to provide a process which is more efficient, flexible and economical to facilitate large-scale production. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

The present invention is directed to a process which produces free flowing, granular detergent agglomerates having a density of at least about 600 g/l. The process produces granular detergent agglomerates from an aqueous and/or non-aqueous surfactant which is then coated with fine powder having a diameter from 0.1 to 500 microns, in order to obtain low density granules.

Process

First Step [Step (a)]

In the first step of the process, surfactant, i.e., one or more of aqueous and/or non-aqueous surfactant(s), which is/are in the form of powder, paste and/or liquid, and fine powder having a diameter from 0.1 to 500 microns, preferably from about 1 to about 100 microns are fed into a mixer, so as to make agglomerates. (The definition of the surfactants and the fine powder are described in detail hereinafter.) Optionally, an internal recycle stream of powder, having a diameter of about 0.1 to about 300 microns generated from fluidizing apparatus which is described hereinafter in the second step, can be fed into the mixer in addition to the fine powder. The amount of such internal recycle stream of powder can be 0 to about 60 wt % of the final product from the process of the present invention.

In another embodiment of the invention, the surfactant(s) can be initially fed into a mixer or pre-mixer (e.g. a conventional screw extruder or other similar mixer) prior to the above, after which the mixed detergent materials are fed into the first step mixer as described herein for agglomeration.

Generally speaking, preferably, the mean residence time of the mixer is in range from about 2 to about 50 seconds and tip speed of the mixer is in range from about 4 m/s to about 25 m/s, the energy per unit mass of the mixer (energy condition) is in range from about 0.15 kj/kg to about 7 kj/kg, more preferably, the mean residence time of the mixer is in range from about 5 to about 30 seconds and tip speed of the mixer is in range from about 6 m/s to about 18 m/s, the energy per unit mass of the mixer (energy condition) is in range from about 0.3 kj/kg to about 4 kj/kg, and most preferably, the mean residence time of the mixer is in range from about 5 to about 20 seconds and tip speed of the mixer is in range from about 8 m/s to about 18 m/s, the energy per unit mass of the mixer (energy condition) is from about 0.3 kj/kg to about 4 kj/kg.

The examples of mixers for the first step can be any types of mixer known to the skilled in the art, as long as the mixer can maintain the above mentioned condition for the first step. An Example can be Lödige CB Mixer manufactured by the Lödige company (Germany). As the result of the first step, resultant product (agglomerates having fine powder on the surface of the agglomerates) is then obtained.

Second Step

In the second step of the process, the resultant product of the first step (the agglomerates) is fed into a fluidized apparatus, such as fluidized bed, in order to enhance granulation for producing free flowing high density granules. The second step can proceed in one or more than one fluidized apparatus (e.g., combining different kinds of fluidized apparatus such as fluid bed dryer and fluid bed cooler). In the second step, the resultant product from the first step is fluidized thoroughly so that the granules from the second step have a round shape. Optionally, about 0 to about 10%, more preferably about 2–5% of powder detergent materials of the kind used in the first step and/or other detergent ingredients can be added to the second step. Also, optionally, about 0 to about 20%, more preferably about 2 to about 10% of liquid detergent materials of the kind used in the first step and/or other detergent ingredients can be added to the step, for enhancing granulation and coating on the surface of the granules.

Generally speaking, to achieve the density of at least about 600 g/l, preferably more than 650 g/l, condition of a fluidized apparatus can be;

Mean residence time: from about 1 to about 10 minutes

Depth of unfluidized bed: from about 100 to about 300 mm

Droplet spray size: not more than about 50 micron

Spray height: from about 175 to about 250 mm

Fluidizing velocity: from about 0.2 to about 1.4 m/s

Bed temperature: from about 12 to about 100° C., more preferably;

Mean residence time: from about 2 to about 6 minutes

Depth of unfluidized bed: from about 100 to about 250 mm

Droplet spray size: less than about 50 micron

Spray height: from about 175 to about 200 mm

Fluidizing velocity: from about 0.3 to about 1.0 m/s

Bed temperature: from about 12 to about 80° C.

If two different kinds of fluidized apparatus would be used, mean residence time of the second step in total can be from about 2 to about 20 minutes, more preferably, from about 2 to 12 minutes.

A coating agent to improve flowability and/or minimize over agglomeration of the detergent composition can be added in one or more of the following locations of the instant process: (1) the coating agent can be added directly after the fluid bed cooler or fluid bed dryer and/or (2) the coating agent may be added between the fluid bed dryer and the fluid bed cooler. The coating agent is preferably selected from the group consisting of aluminosilicates, silicates, carbonates and mixtures thereof. The coating agent not only enhances the free flowability of the resulting detergent composition which is desirable by consumers in that it permits easy scooping for detergent during use, but also serves to control agglomeration by preventing or minimizing over agglomeration. As those skilled in the art are well aware, over agglomeration can lead to very undesirable flow properties and aesthetics of the final detergent product.

Starting Detergent Materials

The total amount of the surfactants in products made by the present invention, which are included in the following detergent materials, finely atomized liquid and adjunct detergent ingredients is generally from about 5% to about 60%, more preferably from about 12% to about 40%, more preferably, from about 15 to about 35%, in percentage ranges. The surfactants which are included in the above can be from any part of the process of the present invention, e.g., from either one of the first step and/or the second step of the present invention.

Detergent Surfactant (Aqueous/Non-aqueous)

The amount of the surfactant of the present process can be from about 5% to about 60%, more preferably from about 12% to about 40%, more preferably, from about 15 to about 35%, in total amount of the final product obtained by the process of the present invention.

The surfactant of the present process, which is used as the above mentioned starting detergent materials in the first step, is in the form of powdered, pasted or liquid raw materials.

The surfactant itself is preferably selected from anionic, nonionic, zwitterionic, ampholytic and cationic classes and compatible mixtures thereof. Detergent surfactants useful herein are described in U.S. Pat. No. 3,664,961, Norris, issued May 23, 1972, and in U.S. Pat. No. 3,929,678, Laughlin et al., issued Dec. 30, 1975, both of which are incorporated herein by reference. Useful cationic surfactants also include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference. Of the surfactants, anionics and nonionics are preferred and anionics are most preferred.

Nonlimiting examples of the preferred anionic surfactants useful in the present invention include the conventional $C_{11}$–$C_{18}$ alkyl benzene sulfonates ("LAS"), primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)\ CH_3$ and $CH_3\ (CH_2)_y(CHOSO_3^-M^+)\ CH_2CH_3$ where x and (y+1) are integers of at least about 7, preferably at least about 9, and M is a water-solubilizing cation, especially sodium, unsaturated sulfates such as oleyl sulfate, and the $C_{10}$–$C_{18}$ alkyl alkoxy sulfates ("$AE_xS$"; especially EO 1–7 ethoxy sulfates).

Useful anionic surfactants also include water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and beta-alkyloxy alkane sulfonates containing from about 1 to 3 carbon atoms in the alkyl group and from about 8 to 20 carbon atoms in the alkane moiety.

Optionally, other exemplary surfactants useful in the paste of the invention include $C_{10}$–$C_{18}$ alkyl alkoxy carboxylates (especially the EO 1–5 ethoxycarboxylates), the $C_{10\text{-}18}$ glycerol ethers, the $C_{10}$–$C_{18}$ alkyl polyglycosides and the corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Cationic surfactants can also be used as a detergent surfactant herein and suitable quaternary ammonium surfactants are selected from mono $C_6$–$C_{16}$, preferably $C_6$–$C_{10}$ N-alkyl or alkenyl ammonium surfactants wherein remaining N positions are substituted by methyl, hydroxyethyl or hydroxypropyl groups.

Ampholytic surfactants can also be used as a detergent surfactant herein, which include aliphatic derivatives of heterocyclic secondary and tertiary amines; zwitterionic surfactants which include derivatives of aliphatic quaternary ammonium, phosphonium and sulfonium compounds; water-soluble salts of esters of alpha-sulfonated fatty acids; alkyl ether sulfates; water-soluble salts of olefin sulfonates; beta-alkyloxy alkane sulfonates; betaines having the formula $R(R^1)_2N^+R^2COO^-$, wherein R is a $C_6$–$C_{18}$ hydrocarbyl group, preferably a $C_{10}$–$C_{16}$ alkyl group or $C_{10}$–$C_{16}$ acylamido alkyl group, each $R^1$ is typically $C_1$–$C_3$ alkyl, preferably methyl and $R_2$ is a $C_1$–$C_5$ hydrocarbyl group, preferably a $C_1$–$C_3$ alkylene group, more preferably a $C_1$–$C_2$ alkylene group. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4[$C_{14-16}$ acylmethylamidodiethylammonio]-1-carboxybutane; $C_{16-18}$ acylamidodimethylbetaine; $C_{12-16}$ acylamidopentanediethylbetaine; and [$C_{12-16}$ acylmethylamidodimethylbetaine. Preferred betaines are $C_{12-18}$ dimethyl-ammonio hexanoate and the $C_{10-18}$ acylamidopropane (or ethane) dimethyl (or diethyl) betaines; and the sultaines having the formula $(R(R^1)_2N^+R^2SO_3^-$ wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group. Examples of suitable sultaines include $C_{12}$–$C_{14}$ dimethylammonio-2-hydroxypropyl sulfonate, $C_{12}$–$C_{14}$ amido propyl ammonio-2-hydroxypropyl sultaine, $C_{12}$–$C_{14}$ dihydroxyethylammonio propane sulfonate, and $C_{16-18}$ dimethylammonio hexane sulfonate, with $C_{12-14}$ amido propyl ammonio-2-hydroxypropyl sultaine being preferred.

Fine Powder

The amount of the fine powder of the present process, which is used in the first step, can be from about 94% to 30%, preferably from 86% to 54%, in total amount of starting material for the first step. The starting fine powder of the present process preferably selected from the group consisting of ground soda ash, powdered sodium tripolyphosphate (STPP), hydrated tripolyphosphate, ground sodium sulphates, aluminosilicates, crystalline layered silicates, nitrilotriacetates (NTA), phosphates, precipitated silicates, polymers, carbonates, citrates, powdered surfactants (such as powdered alkane sulfonic acids) and internal recycle stream of powder occurring from the process of the present invention, wherein the average diameter of the powder is from 0.1 to 500 microns, preferably from 1 to 300 microns, more preferably from 5 to 100 microns. In the case of using hydrated STPP as the fine powder of the present invention, STPP which is hydrated to a level of not less than 50% is preferable. The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z.(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}.(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/-gram/gallon.

Finely Atomized Liquid

The amount of the finely atomized liquid of the present process can be from about 1% to about 10% (active basis), preferably from 2% to about 6% (active basis) in total amount of the final product obtained by the process of the present invention. The finely atomized liquid of the present process can be selected from the group consisting of liquid silicate, anionic or cationic surfactants which are in liquid form, aqueous or non-aqueous polymer solutions, water and mixtures thereof. Other optional examples for the finely atomized liquid of the present invention can be sodium carboxy methyl cellulose solution, polyethylene glycol (PEG), and solutions of dimethylene triamine pentamethyl phosphonic acid (DETMP), The preferable examples of the anionic surfactant solutions which can be used as the finely atomized liquid in the present inventions are about 88–97% active HLAS, about 30–50% active NaLAS, about 28% active AE3S solution, about 40–50% active liquid silicate, and so on.

Cationic surfactants can also be used as finely atomized liquid herein and suitable quaternary ammonium surfactants are selected from mono $C_6$–$C_{16}$, preferably $C_6$–$C_{10}$ N-alkyl or alkenyl ammonium surfactants wherein remaining N positions are substituted by methyl, hydroxyethyl or hydroxypropyl groups.

Preferable examples of the aqueous or non-aqueous polymer solutions which can be used as the finely atomized liquid in the present inventions are modified polyamines which comprise a polyamine backbone corresponding to the formula:

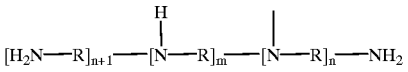

having a modified polyamine formula $V_{(n+1)}W_mY_nZ$ or a polyamine backbone corresponding to the formula:

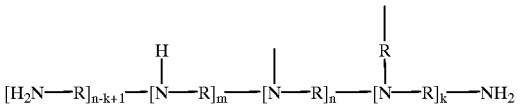

having a modified polyamine formula $V_{(n-k+1)}W_mY_nY'_kZ$, wherein k is less than or equal to n, said polyamine backbone prior to modification has a molecular weight greater than about 200 daltons, wherein i) V units are terminal units having the formula:

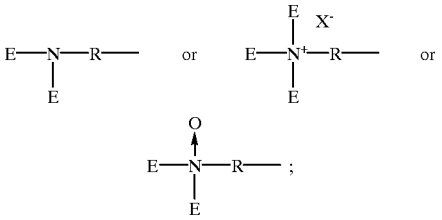

ii) W units are backbone units having the formula:

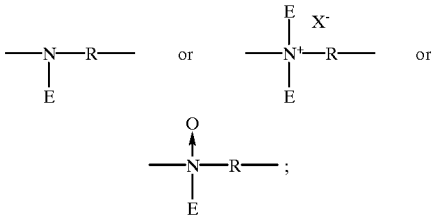

iii) Y units are branching units having the formula:

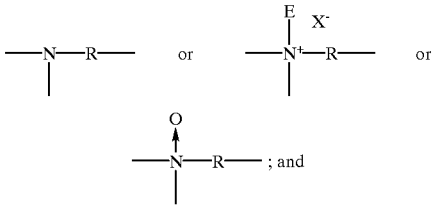

iv) Z units are terminal units having the formula:

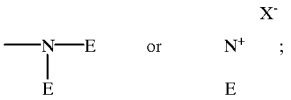

wherein backbone linking R units are selected from the group consisting of $C_2$–$C_{12}$ alkylene, $C_4$–$C_{12}$ alkenylene, $C_3$–$C_{12}$ hydroxyalkylene, $C_4$–$C_{12}$ dihydroxy-alkylene, $C_8$–$C_{12}$ dialkylarylene, —$(R^1O)_xR^1$—, —$(R^1O)_xR^5(OR^1)_x$—, —$(CH_2CH(OR^2)CH_2O)_z(R^1O)_yR^1(OCH_2CH(OR^2)CH_2)_w$—, —$C(O)(R^4)_rC(O)$—, —$CH_2CH(OR^2)CH_2$—, and mixtures thereof; wherein $R_1$ is $C_2$–$C_6$ alkylene and mixtures thereof; $R^2$ is hydrogen, —$(R^1O)_xB$, and mixtures thereof; $R^3$ is $C_1$–$C_{18}$ alkyl, $C_7$–$C_{12}$ arylalkyl, $C_7$–$C_{12}$ alkyl substituted aryl, $C_6$–$C_{12}$ aryl, and mixtures thereof; $R^4$ is $C_1$–$C_{12}$ alkylene, $C_4$–$C_{12}$ alkenylene, $C_8$–$C_{12}$ arylalkylene, $C_6$–$C_{10}$ arylene, and mixtures thereof; $R^5$ is $C_1$–$C_{12}$ alkylene, $C_3$–$C_{12}$ hydroxyalkylene, $C_4$–$C_{12}$ dihydroxy-alkylene, $C_8$–$C_{12}$ dialkylarylene, —C(O)—, —C(O)$NHR^6NHC(O)$—, —$R^1$ $(OR^1)$—, —$C(O)(R^4)_rC(O)$—, —$CH_2CH$ $(OH)CH_2$—, —$CH_2CH(OH)CH_2O(R^1O)_yR^1OCH_2CH(OH)CH_2$—, and mixtures thereof; $R^6$ is $C_2$–$C_{12}$ alkylene or $C_6$–$C_{12}$ arylene; E units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —$(CH_2)_pCO_2M$, —$(CH_2)_qSO_3M$, —$CH(CH_2CO_2M)CO_2M$, —$(CH_2)_pPO_3M$, —$(R^1O)_xB$, —$C(O)R^3$, and mixtures thereof; oxide; B is hydrogen, $C_1$–$C_6$ alkyl, —$(CH_2)_qSO_3M$, —$(CH_2)_pCO_2M$, —$(CH_2)_q(CHSO_3M)CH_2SO_3M$, —$(CH_2)_q$—$(CHSO_2M)CH_2SO_3M$, —$(CH_2)_pPO_3M$, —$PO_3M$, and mixtures thereof; M is hydrogen or a water soluble cation in sufficient amount to satisfy charge balance; X is a water soluble anion; m has the value from 4 to about 400; n has the value from 0 to about 200; p has the value from 1 to 6, q has the value from 0 to 6; r has the value of 0 or 1; w has the value 0 or 1; x has the value from 1 to 100; y has the value from 0 to 100; z has the value 0 or 1. One example of the most preferred polyethyleneimines would be a polyethyleneimine having a molecular weight of 1800 which is further modified by ethoxylation to a degree of approximately 7 ethyleneoxy residues per nitrogen (PEI 1800, E7). It is preferable for the above polymer solution to be pre-complex with anionic surfactant such as NaLAS.

Other preferable examples of the aqueous or non-aqueous polymer solutions which can be used as the finely atomized liquid in the present invention are polymeric polycarboxylate dispersants which can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight of the polymer.

Homo-polymeric polycarboxylates which have molecular weights above 4000, such as described next are preferred. Particularly suitable homo-polymeric polycarboxylates can be derived from acrylic acid. Such acrylic acid-based polymers which are useful herein are the water-soluble salts of polymerized acrylic acid. The average molecular weight of such polymers in the acid form preferably ranges from above 4,000 to 10,000, preferably from above 4,000 to 7,000, and most preferably from above 4,000 to 5,000. Water-soluble salts of such acrylic acid polymers can include, for example, the alkali metal, ammonium and substituted ammonium salts.

Co-polymeric polycarboxylates such as a Acrylic/maleic-based copolymers may also be used. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. It is preferable for the above polymer solution to be pre-complexed with anionic surfactant such as LAS.

Adjunct Detergent Ingredients

The starting detergent material in the present process can include additional detergent ingredients and/or, any number of additional ingredients can be incorporated in the detergent composition during subsequent steps of the present process. These adjunct ingredients include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Other builders can be generally selected from the various water-soluble, alkali metal, ammonium or substituted ammonium phosphates, polyphosphates, phosphonates, polyphosphonates, carbonates, borates, polyhydroxy sulfonates, polyacetates, carboxylates, and polycarboxylates. Preferred are the alkali metal, especially sodium, salts of the above. Preferred for use herein are the phosphates, carbonates, $C_{10-18}$ fatty acids, polycarboxylates, and mixtures thereof. More preferred are sodium tripolyphosphate, tetrasodium pyrophosphate, citrate, tartrate mono- and di-succinates, and mixtures thereof (see below).

In comparison with amorphous sodium silicates, crystalline layered sodium silicates exhibit a clearly increased calcium and magnesium ion exchange capacity. In addition, the layered sodium silicates prefer magnesium ions over calcium ions, a feature necessary to insure that substantially all of the "hardness" is removed from the wash water. These crystalline layered sodium silicates, however, are generally more expensive than amorphous silicates as well as other builders. Accordingly, in order to provide an economically feasible laundry detergent, the proportion of crystalline layered sodium silicates used must be determined judiciously. Such crystalline layered sodium silicates are discussed in Corkill et al, U.S. Pat. No. 4,605,509, previously incorporated herein by reference.

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are tetraborate decahydrate and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylene malonic acid. Some of these materials are useful as the water-soluble anionic polymer as hereinafter described, but only if in intimate admixture with the non-soap anionic surfactant.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

Optional Process Steps

Optionally, the process can comprise the step of spraying an additional binder in the mixer for the present invention. A binder is added for purposes of enhancing agglomeration by providing a "binding" or "sticking" agent for the detergent components. The binder is preferably selected from the group consisting of water, anionic surfactants, nonionic surfactants, liquid silicates, polyethylene glycol, polyvinyl pyrrolidone polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

Other optional steps contemplated by the present process include screening the oversized detergent agglomerates in a screening apparatus which can take a variety of forms including but not limited to conventional screens chosen for the desired particle size of the finished detergent product. Other optional steps include conditioning of the detergent agglomerates by subjecting the agglomerates to additional drying by way of apparatus discussed previously.

Another optional step of the instant process entails finishing the resulting detergent agglomerates by a variety of processes including spraying and/or admixing other conventional detergent ingredients. For example, the finishing step encompasses spraying perfumes, brighteners and enzymes onto the finished agglomerates to provide a more complete detergent composition. Such techniques and ingredients are well known in the art.

Another optional step in the process involves surfactant paste structuring process, e.g., hardening an aqueous anionic surfactant paste by incorporating a paste-hardening material by using an extruder, prior to the process of the present invention. The details of the surfactant paste structuring process are disclosed co-application No. PCT/US96/15960 (filed Oct. 4, 1996) now WO 98/14550.

In order to make the present invention more readily understood, reference is made to the following examples, which are intended to be illustrative only and not intended to be limiting in scope.

EXAMPLES

Example 1

The following is an example for obtaining agglomerates having high density, using Lödige CB mixer (CB-30), followed by Fluid Bed Apparatus for further granulations.

[Step 1] 250–270 kg/hr of aqueous coconut fatty alcohol sulfate surfactant paste ($C_{12}$–$C_{18}$, 71.5% active) is dispersed by the pin tools of a CB-30 mixer along with 220 kg/hr of powdered STPP (mean particle size of 40–75 microns), 160–200 kg/hr of ground soda ash (mean particle size of 15 microns), 80–120 kg/hr of ground sodium sulfate (mean particle size of 15 microns), and the 200 kg/hr of internal recycle stream of powder. The surfactant paste is fed at about 40 to 52° C., and the powders are fed at room temperature. The condition of the CB-30 mixer is as follows:

Mean residence time: 10–18 seconds

Tip speed: 7.5–14 m/s

Energy condition: 0.5–4 kj/kg

Mixer speed: 550–900 rpm

Jacket temperature: 30° C.

[Step 2] The agglomerates from the CB mixer are fed to a fluid bed drying apparatus for drying, rounding and growth of agglomerates. 20–120 kg/hr of liquid silicate (43% solids, 2.0R) can be also added in the fluid bed drying apparatus at 35° C. The condition of the fluid bed drying apparatus is as follows:

Mean residence time: 2–4 minutes

Depth of unfluidized bed: 200 mm

Droplet spray size: less than 50 micron

Spray height: 175–250 mm (above distributor plate)

Fluidizing velocity: 0.4–0.8 m/s

Bed temperature: 40–70° C.]

The resulting granules from the step 2 have a density of about 600 g/l, and can be optionally subjected to the optional process of cooling, sizing and/or grinding.

Example 2

The following is an example for obtaining agglomerates having high density, using Lödige CB mixer (CB-30), followed by Fluid Bed Apparatus for further granulations.

[Step 1] 15 kg/hr–30 kg/hr of HLAS (an acid precursor of $C_{11}$–$C_{18}$ alkyl benzene sulfonate; 95% active) at about 50° C., and 20 kg/hr of $AE_3S$ liquid ($C_{10}$–$C_{18}$ alkyl alkoxy sulfates, EO-3; 28% active) is dispersed by the pin tools of a CB-30 mixer along with 220 kg/hr of powdered STPP (mean particle size of 40–75 microns), 160–200 kg/hr of ground soda ash (mean particle size of 15 microns), 80–120 kg/hr of ground sodium sulfate (mean particle size of 15 microns), and the 200 kg/hr of internal recycle stream of powder. The surfactant paste is fed at about 40 to 52° C., and the powders are fed at room temperature. The condition of the CB-30 mixer is as follows:

Mean residence time: 10–18 seconds

Tip speed: 7.5–14 m/s

Energy condition: 0.5–4 kj/kg

Mixer speed: 550–900 rpm

Jacket temperature: 30° C.

[Step 2] The agglomerates from the CB-30 mixer are fed to a fluid bed drying apparatus for drying, rounding and growth of agglomerates. 20–80 kg/hr of liquid silicate (43% solids, 2.0 R) can be also added in the fluid bed drying apparatus at 35° C. The condition of the fluid bed drying apparatus is as follows:

Mean residence time: 2–4 minutes

Depth of unfluidized bed: 200 mm

Droplet spray size: less than 50 micron

Spray height: 175–250 mm (above distributor plate)

Fluidizing velocity: 0.4–0.8 m/s

Bed temperature: 40–70° C.

The resulting granules from the step 2 have a density of about 600 g/l, and can be optionally subjected to the optional processes of cooling, sizing an/or grinding.

Example 3

The following is an example for obtaining agglomerates having high density, using Lödige CB mixer (CB-30), followed by Fluid Bed Apparatus for further granulations.

[Step 1] 15 kg/hr of HLAS (an acid precursor of $C_{11}$–$C_{18}$ alkyl benzene sulfonate; 95% active) at about 50° C., and 250–270 kg/hr or aqueous coconut fatty alcohol sulfate surfactant paste ($C_{12}$–$C_{18}$, 71.5% active) is dispersed by the pin tools of a CB-30 mixer along with 220 kg/hr of powdered STPP (mean particle size of 40–75 microns), 160–200 kg/hr of ground soda ash (mean particle size of 15 microns), 80–120 kg/hr of ground sodium sulfate (mean particle size of 15 microns), and the 200 kg/hr of internal recycle stream of powder. The surfactant paste is fed at about 40 to 52° C., and the powders are fed at room temperature. The condition of the CB-30mixer is as follows:

Mean residence time: 10–18 seconds

Tip speed: 7.5–14 m/s

Energy condition: 0.5–4 kj/kg

Mixer speed: 550–900 rpm

Jacket temperature: 30° C.

[Step 2] The agglomerates from the CB-30 mixer are fed to a fluid bed drying apparatus for drying, rounding and growth of agglomerates. 20–80 kg/hr of liquid silicate (43% solids, 2.0 R) can be also added in the fluid bed drying apparatus at 35° C. The condition of the fluid bed drying apparatus is as follows:

Mean residence time: 2–4 minutes

Depth of unfluidized bed: 200 mm

Droplet spray size: less than 50 micron

Spray height: 175–250 mm (above distributor plate)

Fluidizing velocity: 0.4–0.8 m/s

Bed temperature: 40–70° C.

The resultant from the fluid bed drying apparatus is fed to a fluid bed cooling apparatus. The condition of the fluid bed cooling apparatus is as follows:

Mean residence time: 2–4 minutes

Depth of unfluidized bed: 200 mm

Fluidizing velocity: 0.4–0.8 m/s

Bed temperature: 12–60° C.]

The resulting granules from the step 2 have a density of about 600 g/l, and can be optionally subjected to the optional processes of cooling, sizing ail/or grinding.

Having thus described the invention in detail, it will be obvious to those skilled in the art that various changes may be made without departing from the scope of the invention and the invention is not to be considered limited to what is described in the specification.

What is claimed is:

1. A non-tower process for preparing a granular detergent composition having a density of at least about 600 g/l, comprising the steps of:

(a) dispersing a surfactant, and coating the surfactant with fine powder having a diameter from 0.1 to 100 microns, in a mixer wherein conditions of the mixer include (i) from about 2 to about 50 seconds of mean residence time, (ii) from about 4 to about 25 m/s of tip speed, and (iii) from about 0.15 to about 7 kj/kg of energy condition, wherein agglomerates are formed; and (b) granulating the agglomerates in one or more fluidizing apparatus wherein conditions of each of the fluidizing apparatus include (i) from about 1 to about 10 minutes of mean residence time, (ii) from about 100 to 300 mm of depth of unfluidized bed, (iii) not more than about 50 micron of droplet spray size, (iv) from about 175 to about 250 mm of spray height, (v) from about 0.2 to about 1.4 m/s of fluidizing velocity and (vi) from about 12 to about 100° C. of bed temperature;

wherein the agglomerates comprise from 54% to 86% by weight of the fine powder in step a) and the fine powder is selected from the group consisting of soda ash, powdered sodium tripolyphosphate, hydrated tripolyphosphate, sodium sulphate, phosphates, precipitated silicates, polymers, citrates, nitrilotriacetates, powdered surfactants and mixtures thereof and optionally further includes from 0 to about 60% by weight of the composition of an internal recycle stream of powder.

2. A process according to claim 1 wherein said surfactant is selected from the group consisting of anionic surfactant, nonionic surfactant, cationic surfactant, zwitterionic, ampholytic and mixtures thereof.

3. A process according to claim 1 wherein said surfactant is selected from the group consisting of alkyl benzene sulfonates, alkyl alkoxy sulfates, alkyl ethoxylates, alkyl sulfates, coconut fatty alcohol sulfates and mixtures thereof.

4. A process according to claim 1 wherein an aqueous or non-aqueous polymer solution is dispersed with said surfactant in step (a).

5. A process according to claim 1, wherein the fine powder is selected from the group consisting of powdered sodium tripolyphosphate, soda ash and sodium sulphate and mixture thereof.

6. The process according to claim 1, wherein the fine powder has an average diameter of from 1 to 100 microns.

7. The process according to claim 1, wherein the fine powder has an average diameter of from 5 to 100 microns.

8. A process according to claim 1 wherein the internal recycle stream of powder from the fluidizing apparatus is further added to step (a).

9. A process according to claim 1 wherein the total amount of surfactants is from about 5% to about 60% by weight in total amount of the composition.

10. A granular detergent composition made according to the process of claim 1.

* * * * *